US009627794B2

(12) United States Patent
Krull et al.

(10) Patent No.: US 9,627,794 B2
(45) Date of Patent: Apr. 18, 2017

(54) CONNECTOR ELEMENT HAVING A CONTACT MODULE ENGAGEMENT

(71) Applicant: Tyco Electronics AMP GmbH, Bensheim (DE)

(72) Inventors: Andreas Krull, Darmstadt (DE); Zoran Stjepanovic, Darmstadt (DE); Jurgen Sauer, Hanau (DE)

(73) Assignee: TE Connectivity Germany GmbH, Bensheim (DE)

( * ) Notice: Subject to any disclaimer, the term of this patent is extended or adjusted under 35 U.S.C. 154(b) by 0 days.

(21) Appl. No.: 14/715,667

(22) Filed: May 19, 2015

(65) Prior Publication Data

US 2015/0255910 A1 Sep. 10, 2015

Related U.S. Application Data

(63) Continuation of application No. PCT/EP2013/074186, filed on Nov. 19, 2013.

(30) Foreign Application Priority Data

Nov. 19, 2012 (DE) ..... 10 2012 221 115

(51) Int. Cl.
*H01R 13/506* (2006.01)
*H01R 13/514* (2006.01)
*H01R 13/629* (2006.01)

(52) U.S. Cl.
CPC ..... *H01R 13/506* (2013.01); *H01R 13/514* (2013.01); *H01R 13/62933* (2013.01)

(58) Field of Classification Search
CPC .. H01R 13/506; H01R 13/508; H01R 13/514; H01R 13/6271; H01R 13/6272; H01R 13/6273; H01R 13/62944; H01R 13/62955; H01R 13/62977; H01R 13/6275
USPC ..... 439/352, 701, 353, 354, 372, 595
See application file for complete search history.

(56) References Cited

U.S. PATENT DOCUMENTS 4,923,408 A 5/1990 Zinn
5,628,648 A 5/1997 Higgins, Jr. et al.
5,975,929 A * 11/1999 Matsuura ..... H01R 13/62972 439/157

(Continued)

FOREIGN PATENT DOCUMENTS

CN 102160243 A 8/2011
DE 8715118 U1 3/1989

(Continued)

OTHER PUBLICATIONS

PCT International Search Report, International Application No. PCT/EP2013/074186, dated Feb. 6, 2014, 4 pages.

(Continued)

*Primary Examiner* — Abdullah Riyami
*Assistant Examiner* — Harshad Patel
(74) *Attorney, Agent, or Firm* — Barley Snyder

(57) ABSTRACT

An electrical connector has a connector housing and a contact receiving body. The connector housing has a body receiving space, a body receiving end, a terminating end wall positioned opposite the body receiving end and having an inner surface facing the body receiving space, a body receiving opening positioned on the body receiving end, and a first locking mechanism positioned on the inner surface of the terminating end wall.

19 Claims, 7 Drawing Sheets

(56) References Cited

U.S. PATENT DOCUMENTS

| | | | | |
|---|---|---|---|---|
| 5,997,359 | A | 12/1999 | Picaud et al. | |
| 6,231,398 | B1 | 5/2001 | Furutani et al. | |
| 6,682,359 | B1 * | 1/2004 | Hitchcock | H01R 13/62944 439/153 |
| 6,935,997 | B2 * | 8/2005 | Kling | G06T 17/20 493/356 |
| 7,114,998 | B2 | 10/2006 | Ishikawa et al. | |
| 7,476,123 | B2 * | 1/2009 | Kobayashi | H01R 13/4361 439/352 |
| 8,235,744 | B1 * | 8/2012 | Liptak | H01R 13/639 439/352 |
| 2004/0142591 | A1 | 7/2004 | Yamaki | |
| 2005/0245122 | A1 * | 11/2005 | Fisher | H01R 13/6272 439/352 |
| 2006/0281350 | A1 | 12/2006 | Yamamoto | |
| 2007/0054537 | A1 | 3/2007 | Nakamura | |
| 2007/0178739 | A1 | 8/2007 | Kuwayama | |
| 2011/0223789 | A1 | 9/2011 | Sasaki et al. | |

FOREIGN PATENT DOCUMENTS

| | | | |
|---|---|---|---|
| DE | 102007037176 | B3 | 2/2009 |
| DE | 102007037177 | A1 | 2/2009 |

OTHER PUBLICATIONS

Abstract of DE102007037176, dated Feb. 26, 2009, 1 page.
Abstract of DE102007037177, dated Feb. 19, 2009, 2 pages.
English translation of First Office Action, dated Jun. 6, 2016, 9 pages.
Chinese Office Action, dated Jun. 6, 2016, 7 pages.
English translation of the First Office Action and Search Report, dated Jun. 6, 2016, 9 pages.
European communication, dated Jan. 26, 2017. 7 pages.

* cited by examiner

CONNECTOR ELEMENT HAVING A CONTACT MODULE ENGAGEMENT

CROSS-REFERENCE TO RELATED APPLICATION

This application is a continuation of PCT International Application No. PCT/EP2013/074186 filed Nov. 19, 2013, which claims priority under 35 U.S.C. §119 to German Patent Application No 10 2012 221 115.2 filed Nov. 19, 2012.

FIELD OF THE INVENTION

The invention is generally related to an electrical connector, and, more specifically, to an electrical connector having a latching mechanism.

BACKGROUND

Electrical connectors having housings and contact receiving bodies are conventionally used in plug type connectors which are constructed in a modular manner. The plug connectors generally mate with corresponding pin or socket contacts positioned in a complimentary socket type connector. The plug type connectors often have plug type contacts configured in functional groups. The groups of plug type contacts each transmit electrical signals or currents which are used to control or supply electrical power to specific functional units connected to the plug type connector. The plug type connector can thus be used, for example, in a motor vehicle, in which a large number of electrical functions can be implemented in a variable manner.

A conventional plug type connector is described, for example, in the patent specification DE 10 2007 037 176 B3 and the patent application DE 10 2007 037 177 A1. These conventional plug type connectors include catch elements laterally positioned in a connector housing, where the catch elements engage a contact receiving body in a body receiving space. Accordingly, complimentary counter-catch elements are positioned on the side walls of the contact receiving bodies.

These conventional plug type connectors suffer from the catch elements becoming unintentionally actuated, resulting in the contact receiving body being inadvertently released from engagement. The catch elements can also become damaged when the plug type connector is handled, which impairs the engagement of the contact receiving body. Furthermore, the plug type connectors are often produced using an injection-moulding method that is complicated by the intricacies associated with forming the catch elements.

SUMMARY

An electrical connector has a connector housing and a contact receiving body. The connector housing has a body receiving space, a body receiving end, a terminating end wall positioned opposite the body receiving end and having an inner surface facing the body receiving space, a body receiving opening positioned on the body receiving end, and a first locking mechanism positioned on the inner surface of the terminating end wall.

BRIEF DESCRIPTION OF THE DRAWINGS

The invention will now be described by way of example, with reference to the accompanying Figures, of which.

DETAILED DESCRIPTION OF THE EMBODIMENT(S)

Figure 1:
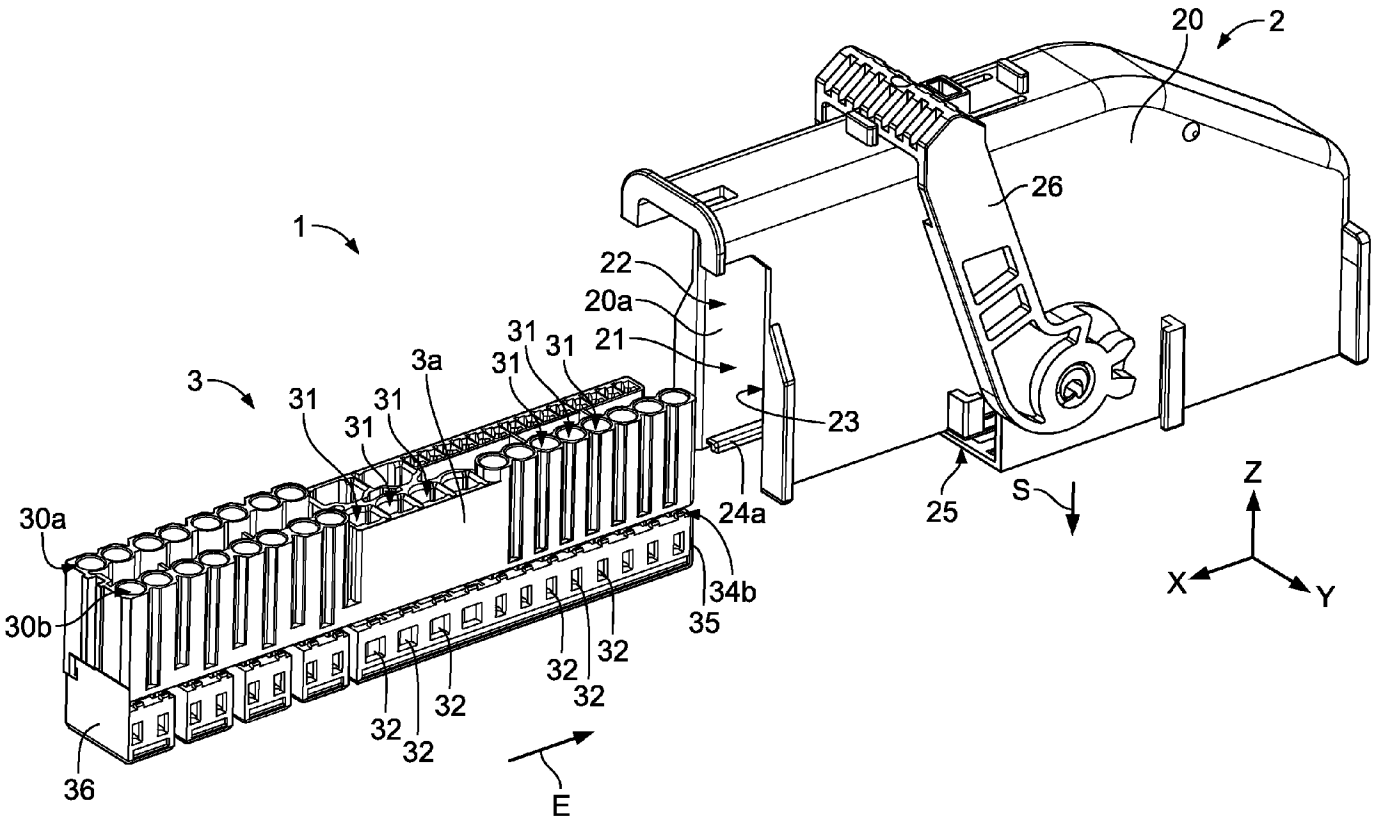
FIG. 1 is an exploded view of an electrical connector in a preassembled state.

The invention will now be described with reference to various embodiments disclosed in FIGS. 1-13. In the following description of the embodiments, for reasons of simplicity, features and elements which are the same have been given the same reference numerals. Features and elements having the same or at least similar functionality generally have the same reference numeral or the same reference letter, which is provided with one or more apostrophes in order to distinguish different variations and embodiments.

As shown in the embodiment of FIG. 1, an electrical connector 1 comprises a connector housing 2 and a contact receiving body 3. The connector housing 2 has a housing wall 20, which surrounds a receiving space 21 of the connector housing 2. A body receiving opening 22 is positioned on a body receiving end of the housing wall 20, through which the contact receiving body 3 can be introduced in an insertion direction E into a body receiving space 23. The body receiving space 23 is at least partially arranged in the receiving space 21. The body receiving space 23 is at least partially defined by two opposing inner walls 20*a*, 20*b* of the housing wall 20. Guiding elements 24*a*, 24*b* are positioned on the inner walls 20*a*, 20*b*, extending substantially parallel with the insertion direction E and serving as a guide track to guide the insertion of the contact receiving body 3 in the insertion direction E. The guiding elements 24*a*, 24*b* also support the contact receiving body 3 orthogonally relative to the insertion direction E.

The connector housing 2 further includes a mating connector receiving opening 25 through which the connector housing 2 is opened in a mating direction S that extends orthogonally relative to the insertion direction E. A corresponding mating connector (not shown) can be brought into contact in an electrically conductive manner with contacts (not shown) positioned in the contact receiving body 3. Furthermore, the electrical connector 1 has a locking mechanism 26 which is connected to the connector housing 2 and through which the electrical connector 1 can be joined together with the mating connector (not shown) in the mating direction S, and can be locked in a mating position.

The contact receiving body 3 has two rows 30*a*, 30*b* of contact receiving spaces 31. The rows 30*a*, 30*b* extend substantially parallel with the insertion direction E and consequently parallel with a longitudinal axis X of the electrical connector 1. The rows 30*a*, 30*b* are arranged adjacent to each other in a width direction Y of the electrical connector 1 extending substantially perpendicularly relative to the longitudinal axis X. The contact receiving members 31 extend substantially parallel with a height direction Z of the electrical connector 1. The longitudinal axis X extends substantially along the insertion direction E. The height direction Z extends substantially along the mating direction S.

The contact receiving body 3 has a contact retaining portion 3*a* and a mating connector engaging portion 3*b*. The contact retaining portion 3*a* is positioned on an upper side of the mating connector engaging portion 3*b* in the mating direction S. In the contact retaining portion 3*a*, the contacts and connection locations are positioned with electrical or optical conductors (not shown) secured to the contacts. The mating connector engaging portion 3*b* is configured to be joined to a corresponding connector engaging portion of the mating electrical connector (not shown). The mating connector engaging portion 3*b* includes a contact securing mechanism in the form of openings which extend substantially parallel with the width direction Y into the contact receiving members 31 and in which the contacts can be secured.

Furthermore, the contact receiving body 3 has guiding grooves 34*a*, 34*b* which extend substantially parallel with the insertion direction E. The guiding grooves 34*a*, 34*b* are positioned on opposite sides of the contact receiving body 3, each extending along the longitudinal axis X. The guiding grooves 34*a*, 34*b* have a depth that extends into the contact receiving body 4 in the width direction Y. When the contact receiving body 3 is inserted into the body receiving space 23, the complimentary guiding elements 24*a*, 24*b* of the connector housing 2 are positioned in the guiding grooves 34*a*,34*b* such that the guiding elements 24*a*,24*b* extend into the contact receiving members 31 and secure the contact receiving body 3 in the connector housing 2. The contact receiving body 3 can thus be positioned into the connector housing 2 by being guided by the inner walls 20*a*, 20*b* and the guiding elements 24*a*, 24*b*, with an insertion end 35 of the contact receiving body 3 being firstly inserted through the body receiving opening 22 in the insertion direction E into the body receiving space 23. During insertion, the interaction of the guiding elements 24*a*, 24*b* and the guiding grooves 34*a*, 34*b* serve as a verification of a correct arrangement of the contacts in the respective receiving members 31 thereof.

Figure 2:
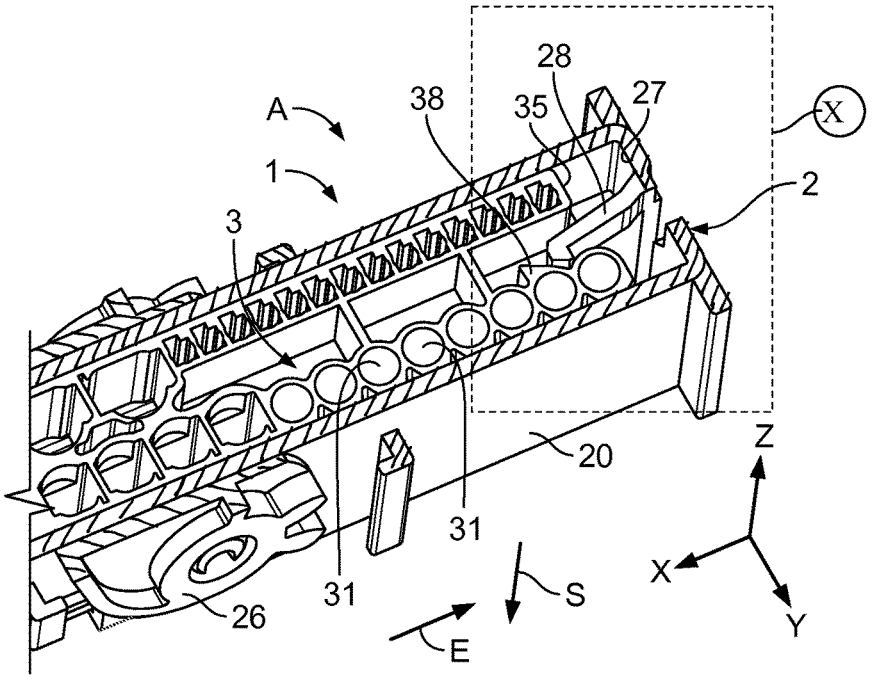
FIG. 2 is a cross-sectional view of a contact receiving body positioned in a connector housing in a preassembled position.
Figure 3:
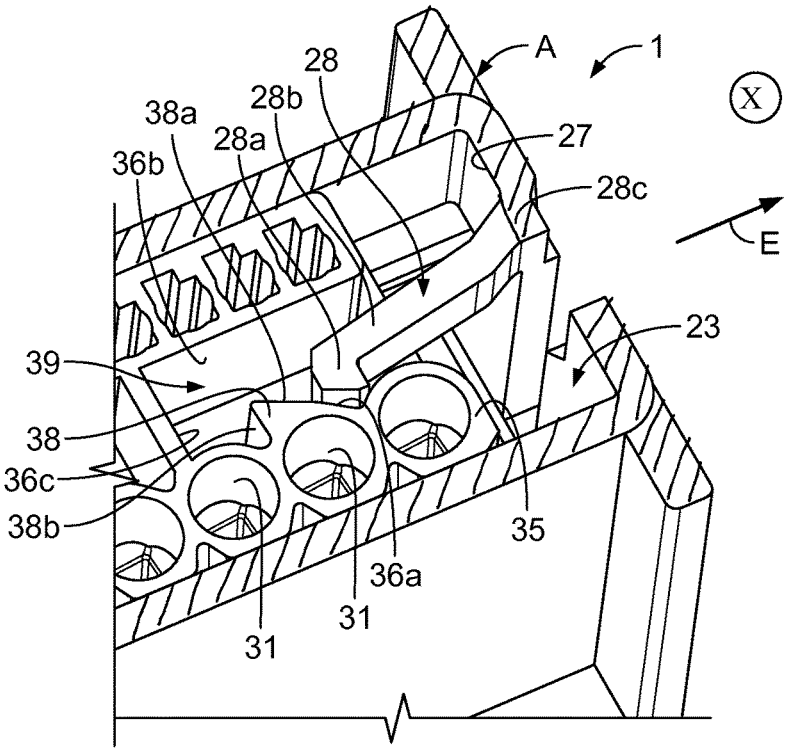
FIG. 3 is an enlarged cross-sectional view of section XI in FIG. 2.

In the embodiments shown in FIGS. 2 and 3, the electrical connector 1 the contact receiving body 3 is positioned in the body receiving space 23 in a preassembled position A. In the preassembled position A, a first locking mechanism 28 is positioned on an inner surface of the body receiving space 23 on, a terminating end wall 27 of the connector housing 2 and abuts a complimentary second locking mechanism 38 of the contact receiving body 3 that is positioned proximate the insertion end 35.

In the embodiments shown in FIGS. 2 and 3, the first locking mechanism 28 extends into the body receiving space 23 from the inner surface of the terminating end wall 27 opposite the insertion direction E along the longitudinal axis X. In an embodiment, the first locking mechanism 28 is a cantilevered, resilient latching arm 28*b* extending from the inner surface of the terminating end wall 27 at a substantially acute angle relative to the longitudinal axis X. The first locking mechanism 28 comprises a latching projection 28*a* positioned on a free end of the latching arm 28*b*, extending substantially in the width direction Y away from the resilient latching arm 28*b*. The latching arm 28*b* has a fixed end 28*c* that is connected to the terminating end wall 27 of the body receiving space 23.

The second locking mechanism 38 is complimentary to the first locking mechanism 28, being a corresponding catch projection that extends in the width direction Y, away from the inner side wall 36*a* of the contact receiving body 3. The second locking mechanism 38 has an angled surface 38*a* and a retention surface 38*b*. In the preassembled position A, the latching projection 28*a* abuts the inclined angled surface 38*a* and consequently produces a noticeable resistance when the contact receiving body is pushed into the body receiving space 23 along the insertion direction E.

The contact receiving body 3 includes the inner side wall 36*a*, an opposing second inner side wall 36*b*, and a connecting end wall 36*c* extending therebetween, which collectively form a latching arm receiving space 39. The second locking mechanism 38 is positioned within the latching arm receiving space 39, and during an engagement of the first locking mechanism 28 with the second locking mechanism 38, the free end of the latching arm 28*b* is positioned in the latching arm receiving space 39. The latching arm receiving space 39 protects the first and second locking mechanisms 28, 38 against external influences.

Figure 4:
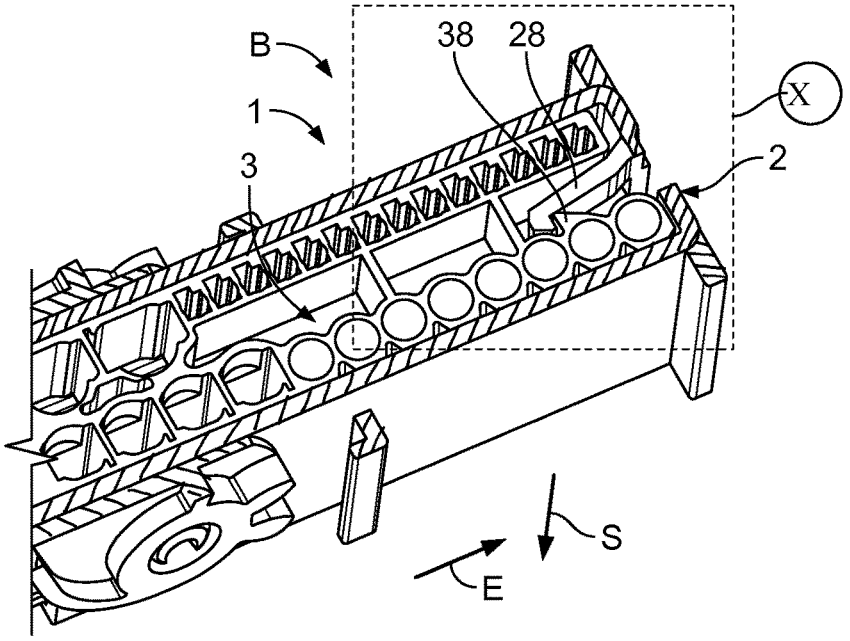
FIG. 4 is a cross-sectional view of the contact receiving body positioned in the connector housing in an assembled position.
Figure 5:
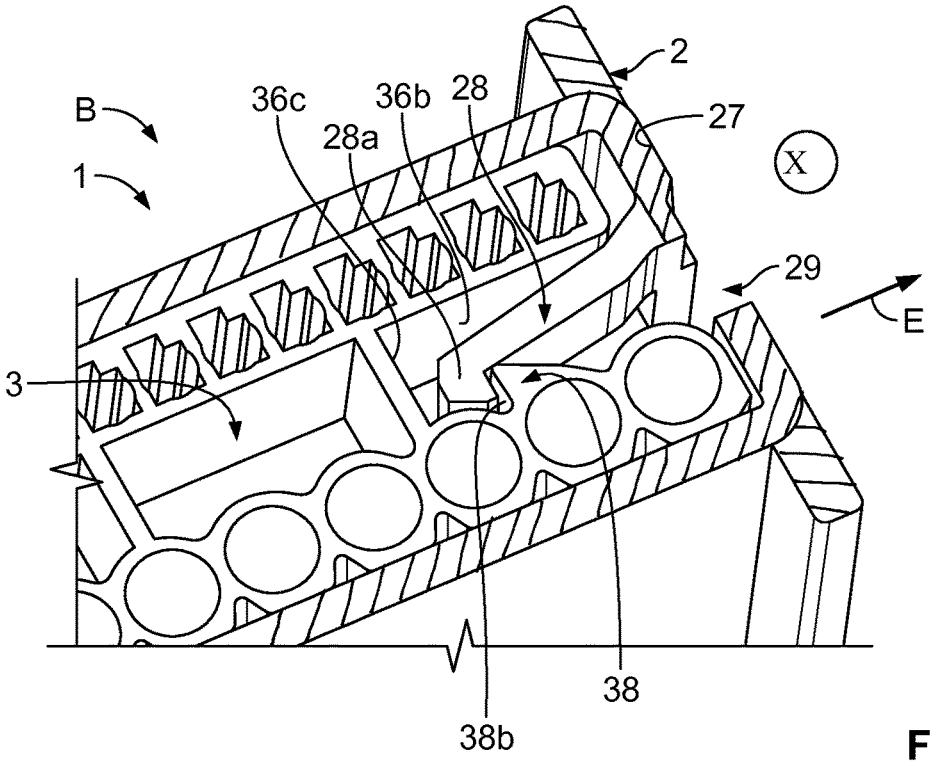
FIG. 5 is an enlarged cross-sectional view of section XII in FIG. 4.

In the embodiments shown in FIGS. 4 and 5 contact receiving body 3 being moved into an assembled positioned B in which first locking mechanisms 28 and second locking mechanisms 38 engage one inside latching arm receiving space 39. In the assembled position B, the contact receiving body 3 is connected to the connector housing 2 by the first and second locking mechanism 28, 38, which prevent the contact receiving body 3 from being pulled out of the body receiving space 23 in a direction opposite to the insertion direction E.

As shown in the embodiments of FIGS. 4 and 5, the latching projection 28 is positioned against retention surface 38*b* such that the first locking mechanisms 28 and the second locking mechanisms 38 overlap each other in a projection in the insertion direction E. The contact receiving body 3 is consequently engaged in the connector housing 2. A tool receiving passageway 29 is formed in the connector housing 2 to create a tool receiving passageway through the terminating end wall 27 of the body receiving space 23. Via the tool receiving passageway 29, an unlocking tool can be brought into contact with the first locking mechanism 28 in order to move it counter to the width direction Y and consequently to release it from the second locking mechanism 38, thus allowing the contact receiving body 3 to be removed from the body receiving space 23 counter to the insertion direction E.

Figure 6:
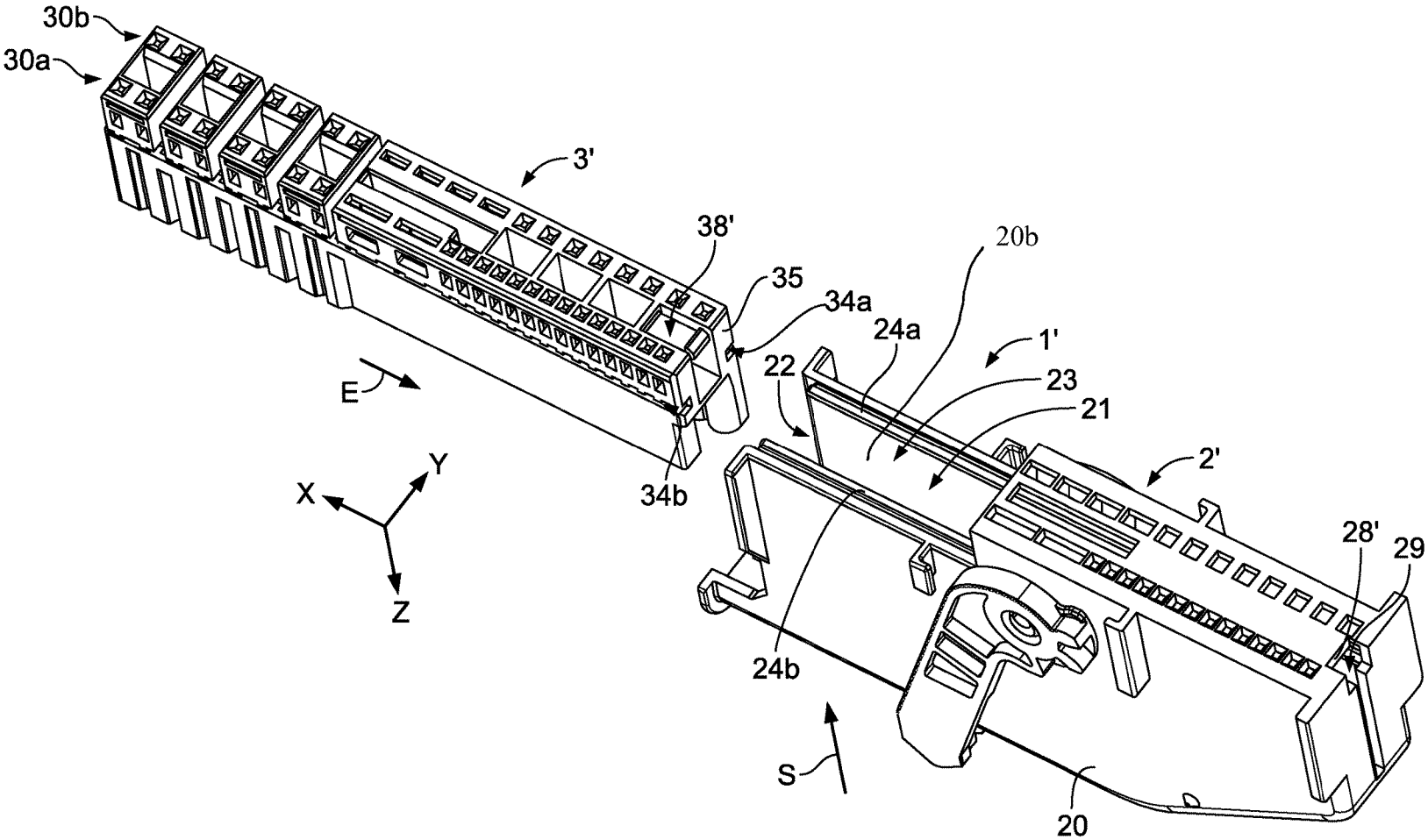
FIG. 6 is an exploded perspective view of an electrical connector.

FIG. 6 shows an embodiment of an electrical connector 1' with a connector housing 2' having a first locking mechanism 28' and a contact receiving body 3' having a second locking mechanism 38'.

Figure 7:
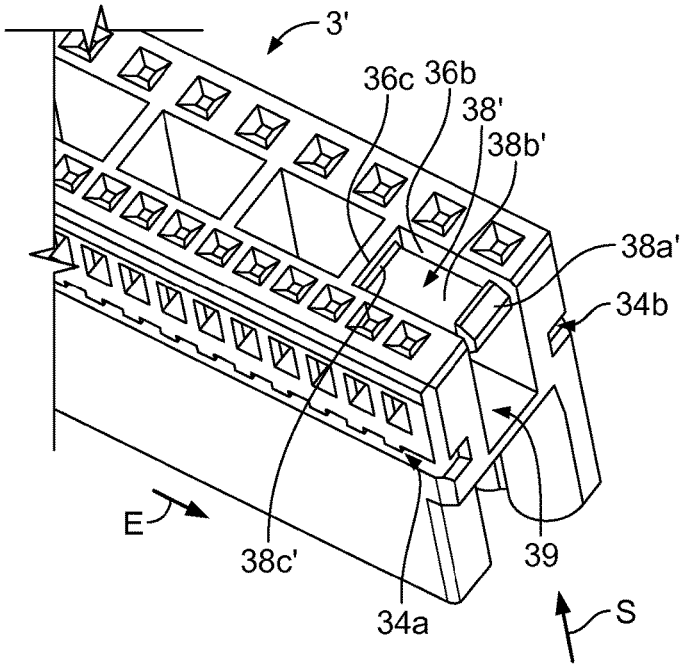
FIG. 7 is an enlarged perspective view of a contact receiving body in FIG. 6.

In the embodiment shown in FIG. 7, the second locking mechanism 38' has a cantilevered latching arm 38*b*' extending along the contact receiving body 3' substantially parallel with the insertion direction E or longitudinal axis X. A catch projection 38*a*' is positioned on a free end of the latching arm 38*b*', extending away from the latching arm 38*b*' substantially in a mating direction S or opposite to the height direction Z. The latching arm 38*b*' is connected to the connecting end wall 36*c* of the contact receiving body 3' at a fixed end 38*c*' opposite the free end. Consequently, the second locking mechanism 38' is positioned in the latching arm receiving space 39 of the contact receiving body 3', and is positioned so as to be protected inside an outer contour of the contact receiving body 3' when viewed both in the mating direction S and in the insertion direction E.

Figure 8:
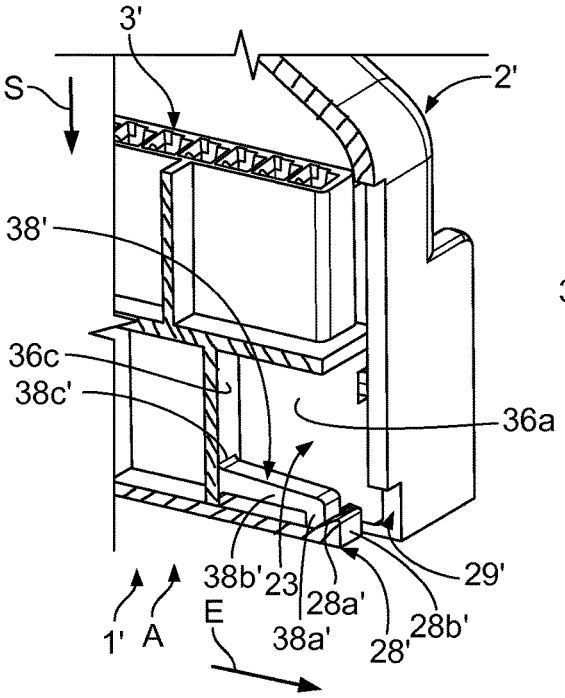
FIG. 8 is a cross-sectional view of the contact receiving body in FIG. 6 positioned in a connector housing in a pre-assembly position.

In an embodiment shown in FIG. 8, the contact receiving body 3' is partially positioned in the body receiving space 23 of the connector housing 2' in the preassembled position A. In the preassembled position A, the catch projection 38*a*' of the second locking mechanism 38' is positioned adjacent to, or abutting, a corresponding angled surface 28*a*' of the first locking mechanism 28'.

Figure 9:
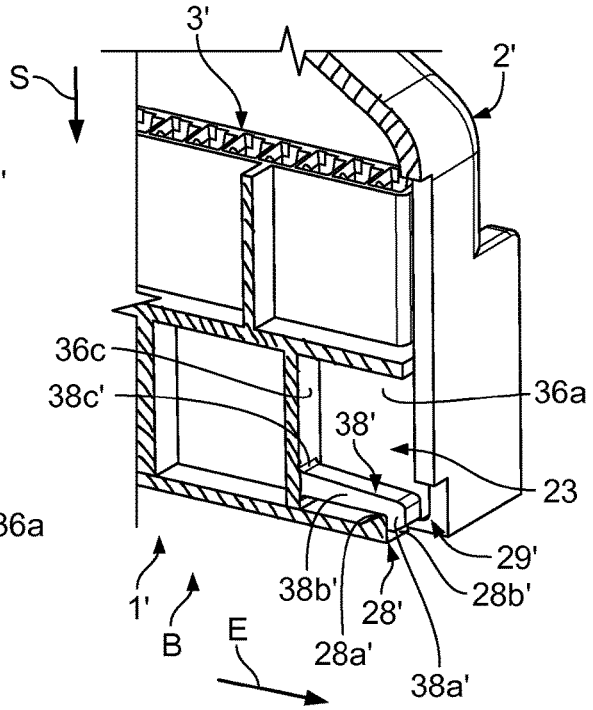
FIG. 9 is a cross-sectional view of the contact receiving body in FIG. 6 positioned in the connector housing in an assembled position.

In an embodiment shown in FIG. 9, in contrast to FIG. 8, the contact receiving body 3' has been further displaced in the insertion direction E and is in an assembled positioned B. In the assembled positioned B, the catch projection 38*a*' of the second locking mechanism 38' has been displaced along the inclined angled surface 28*a*' of the first locking mechanism 28' and abuts a corresponding retention surface 28*b*' of the first locking mechanism 28'. As shown in FIG. 9, the retention surface 28*b*' is faces in the insertion direction E. Consequently, in the assembled position, the contact receiving body 3' is secured against being pulled out of the module receiving member 23 in a direction counter to the insertion direction E. In order to release the engagement of the contact receiving body 3', a corresponding tool can be introduced through the tool receiving passageway 29 into the body receiving space 23 in order to lift the catch projection 38*a*' counter to the mating direction S, over the first locking mechanism 28' or the retention surface 28*b*' thereof. The contact receiving body 3' can then be displaced in a direction counter to the insertion direction E from the module receiving member 23.

Figure 10:
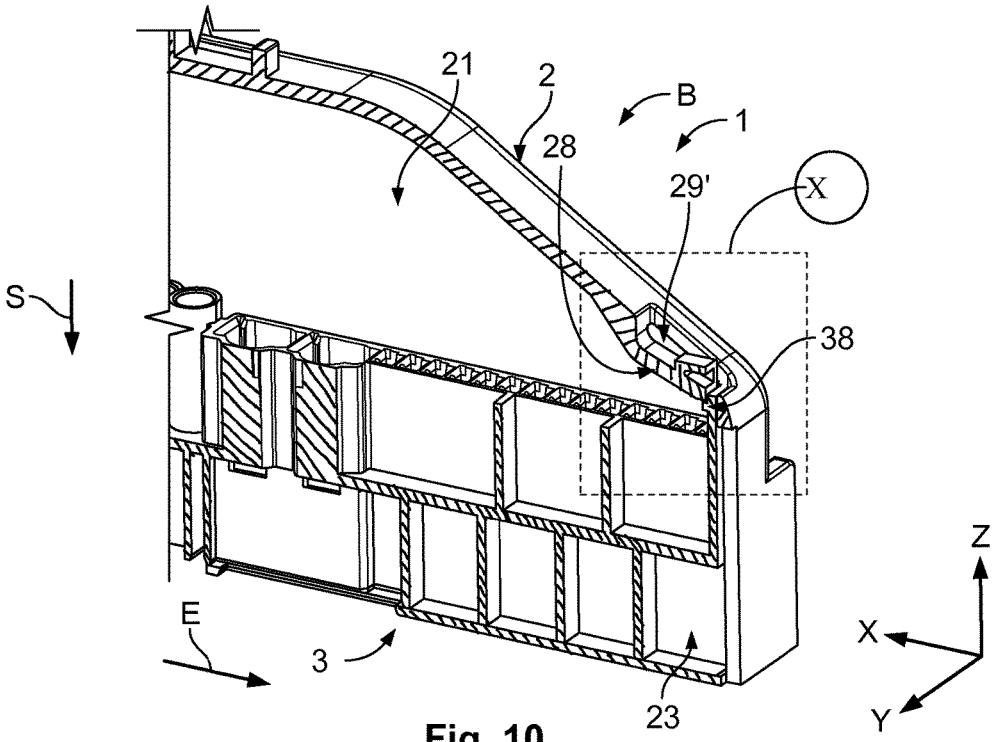
FIG. 10 is a cross-sectional view of an electrical connector having the contact receiving body positioned in the connector housing.

In an embodiment shown in FIG. 10 an electrical connector 1" has a connector housing 2" and a contact receiving body 3" positioned in the receiving space 21. In contrast to the electrical connectors 1,1', engagement of a first locking mechanism 28' and a second locking mechanism 38' is at a position above the body receiving space 23 along the height direction Z, on an upper portion of the connector housing 2" opposite the mating connector receiving opening 25.

Figure 11:
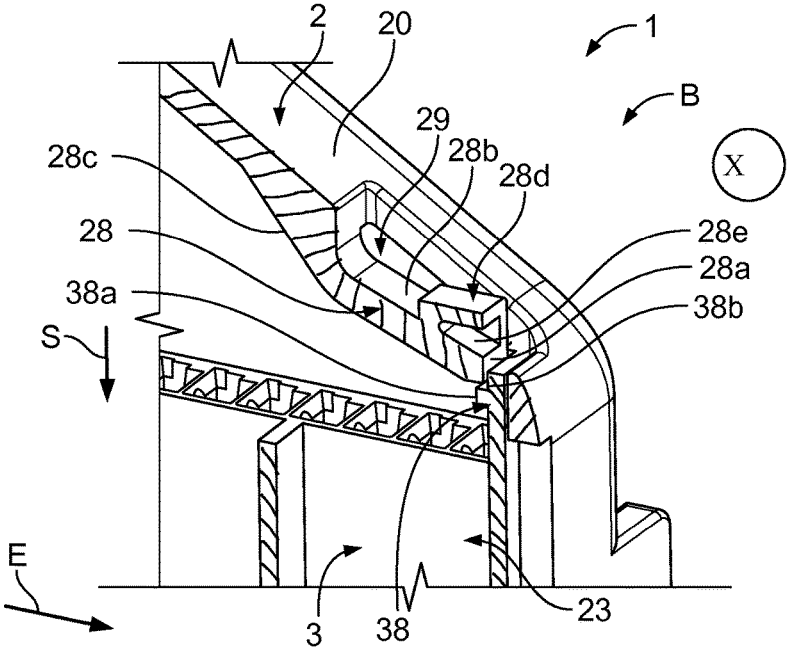
FIG. 11 is an enlarged perspective view of section XIII in FIG. 10.

In the embodiment shown in FIG. 11, the first locking mechanism 28" has a latching projection 28*a*" and a latching arm 28*b*". The latching arm 28*b*" is connected to an inclined upper covering portion of the housing wall 20 of the connector housing 2" at a fixed end 28*c*". The latching arm 28*b*" extends from the housing wall 20 substantially in an inclined manner to the longitudinal axis X and height direction Z and orthogonally relative to the width direction Y. The first locking mechanism 28" includes an actuation member 28*d*" positioned on an outward facing surface of the latching arm 28*b*", the actuation member 28*d*" protruding out of the connector housing 2" through an opening 29' disposed in the housing wall 20 of the connector housing 2". The latching arm 28*b*" includes tool receiving space 28*e*" is positioned between the actuation member 28*d*" and the outward facing surface of the latching arm 28*b*". The second locking mechanism 38" is positioned on the contact receiving body 3", having a shoulder 38*a*" and a retention surface 38*b*". The shoulder 38*a*" extends substantially in the width direction Y, protruding along the longitudinal axis X from the retention surface 38*b*", which is positioned to face in a direction opposite to the insertion direction E.

In the assembled position B shown in the embodiments of FIGS. 10 and 11, the contact receiving body 3" is positioned in the body receiving space 23 of the connector housing 2" in the insertion direction E and the second locking mechanism 38" has passed the first locking mechanism 28". In the assembled position B, the latching projection 28*a*" of the first locking mechanism 28" is positioned further in the insertion direction E than that of the retention surface 38*b*", such that the latching projection 28*a*" overlaps the retention surface 38*b*". In the assembled position B, the contact receiving body 3 is secured to the connector housing 2" and is prevent from being pulled out of the module receiving member 23 in a direction opposite to the insertion direction E.

Figure 12:
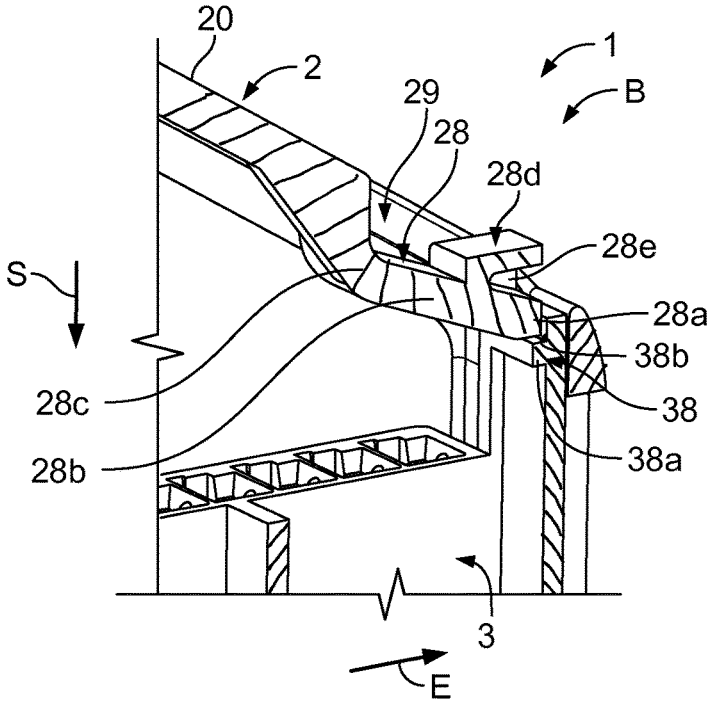
FIG. 12 is an enlarged perspective view of section XIII in FIG. 11.
Figure 13:
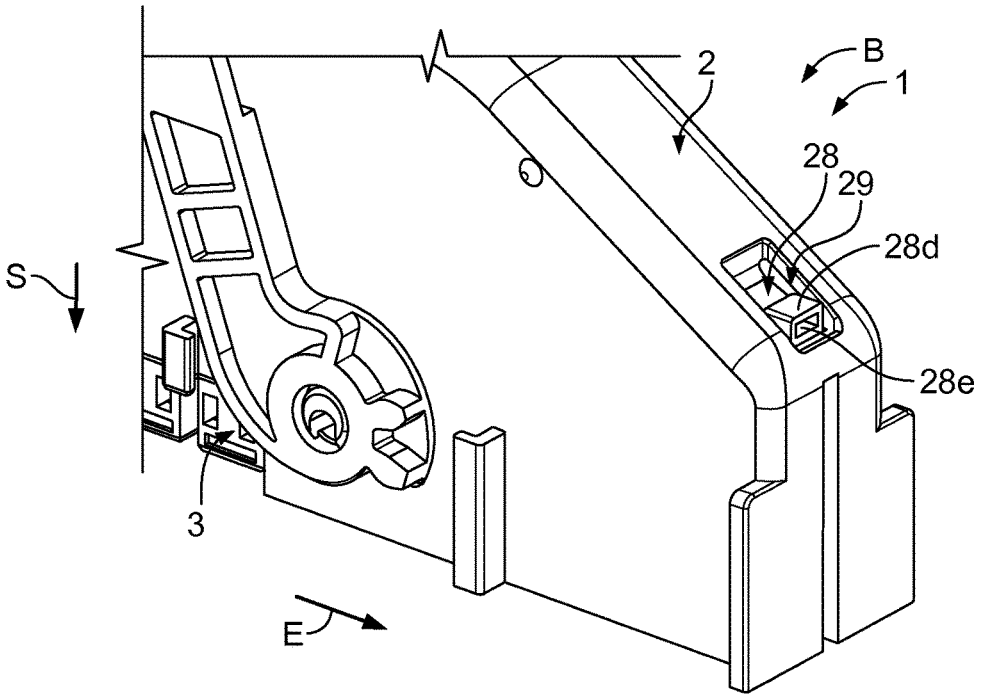
FIG. 13 is an enlarged perspective view of the electrical connector in FIG. 10 with the contact receiving body positioned in the connector housing in the assembled position.

In the embodiments shown in FIGS. 11-13, the actuation member 28*d*" of the first locking mechanism 28" protrudes through the tool receiving passageway 29" in the housing wall 20 of the connector housing 2" so that a tool can be introduced in a direction counter to the insertion direction E into the tool receiving space 28*e*". The tool can lift the latching projection 28*e*" in a direction counter to the mating direction S, from the shoulder 38*a*" and over the retention surface 38" in order to release the engagement of the connector receiving body 3" from the connector housing 2".

In the embodiment of FIG. 13, the connector housing 2" is shown with the contact receiving body 3" in the assembled positioned B, where the actuation member 28*d*" extends through the opening 29". The first locking mechanism 28" is positioned primarily inside the connector housing 2" or in the receiving space 21 thereof. In particular, the latching projection 28*a*" of the first locking mechanism 28" is positioned inside the connector housing 2" so as to be protected from harmful, external influences.

Those of ordinary skill in the art would appreciate that modifications of the above-described embodiments are possible. For example, the electrical connector 1, 1', 1" may thus have any number of connector housings 2, 2', 2". Additionally, the contact receiving bodies 3, 3', 3" with contact retaining portions 3*a* and mating connector engaging portions 3*b* which may be constructed in accordance with the respective requirements in order to provide the electrical connector 1, 1', 1" with contacts (not shown) and join it to a mating electrical connector (not shown).

The connector housing 2, 2', 2" may be constructed in accordance with the respective requirements so as to have a housing wall 20 which forms an receiving space 21 which is formed in accordance with the respective requirements and which is defined by inner walls 20*a*, 20*b*, and forms a body receiving space 23 which is accessible through an body receiving opening 22. The body receiving space 23 may be formed in accordance with the respective requirements and be provided with guiding elements 24*a*, 24*b* and with a mating connector receiving opening 25. Furthermore, a locking mechanism 26 may be positioned on the connector housing 2, 2', 2" in accordance with the respective requirements. The first locking mechanism 28, 28', 28" can be constructed in accordance with the respective requirements and positioned on the terminating end wall 27 of the connector housing. In other embodiments, the first locking mechanism 28, 28', 28" is positioned in the receiving space 21 and is accessible through the tool receiving passageway 29, 29', 29". A first locking mechanism 28, 28' 28", in accordance with the respective requirements, may be provided with latching projections 28*a*, 28*a*", latching arms 28*b*, 28*b*", fixed ends 28*c*, 28*c*", inclined angled surfaces 28*a*, retention surfaces 28*b*', actuation members 28*d*" and tool receiving spaces 28*e*".

A contact receiving body 3, 3', 3", in accordance with the respective requirements, may be provided with rows 30*a*, 30*b* of contact receiving members 31, which may have contact securing members 32. The guiding grooves 34*a*, 34*b* may be constructed in accordance with the respective requirements so as to be complementary to the guiding elements 24*a*, 24*b* and allow insertion of the contact receiving body 3, 3', 3" substantially parallel with the insertion direction E, The guide grooves 34*a*,34*b* assist in a stable retention of the contact receiving body 3, 3', 3" in the body receiving space 23. A terminating end wall 35, an inner side wall 36*a*, 36*b*, a second locking mechanism 38, 38', 38" and a connecting wall 36*c* may be constructed in accordance with the respective requirements and be positioned in a latching arm receiving space 39. A second locking mechanism 38, 38', 38", in accordance with the respective requirements, may be constructed so as to have inclined angled surfaces 38*a*, retention surfaces 38*b*, catch projections 38*a*', latching arms 38*b*', fixed ends 38*c*', shoulders 38*a*" and retention surfaces 38*b*" in order to engage the contact receiving body 3, 3', 3" on the connector housing 2, 2', 2".

A contact receiving body 3, 3', 3" may be moved from a preassembled position A into an assembled positioned B in which the contact receiving body 3, 3', 3" is secured against being pulled out of the body receiving space 23 in a direction counter to the insertion direction E. The insertion direction E and the mating direction S do not necessarily have to extend perpendicularly relative to each other as shown here, but may also be orientated with respect to each other in accordance with the respective requirements, which also applies to the orientation of the insertion direction E and mating direction S relative to the longitudinal axis X, width direction Y and height direction Z.

What is claimed is:

1. An electrical connector comprising:

a connector housing having a body receiving space, a body receiving end, a terminating end wall forming a terminating end of the connector housing opposite the body receiving end and having an inner surface facing the body receiving space, a body receiving opening positioned on the body receiving end, and a first locking mechanism extending from the inner surface of the terminating end wall; and a contact receiving body.

2. The electrical connector of claim 1, wherein the first locking mechanism protrudes from the inner surface into the body receiving space.

3. The electrical connector of claim 1, wherein the connector housing further comprises a receiving space.

4. The electrical connector of claim 3, wherein the first locking mechanism is positioned in the receiving space.

5. The electrical connector of claim 1, wherein the connector housing further comprises a tool receiving opening positioned proximate the first locking mechanism.

6. The electrical connector of claim 1, wherein the contact receiving body is slideable into the body receiving space through the body receiving opening towards the terminating end wall in an insertion direction.

7. The electrical connector of claim 6, wherein the first locking mechanism is a cantilevered latching arm having a free end and an opposite fixed end.

8. The electrical connector of claim 7, wherein the fixed end is connected to the connector housing and the latching arm extends from the fixed end to the free end in a direction opposite the insertion direction.

9. The electrical connector of claim 8, wherein the contact receiving body includes an insertion end; and a second locking mechanism positioned proximate to the insertion end.

10. The electrical connector of claim 9, wherein the second locking mechanism engages the first locking mechanism when the contact receiving body is positioned in the body receiving space.

11. The electrical connector of claim 10, wherein the contact receiving body has a latching arm receiving space positioned on the insertion end.

12. The electrical connector of claim 11, wherein the second locking mechanism is positioned in the latching arm receiving space.

13. The electrical connector of claim 10, wherein:

the first locking mechanism has a latching projection positioned on the free end of the latching arm; and the second locking mechanism has a complimentary retention surface that engages the latching projection when the contact receiving body is positioned in the body receiving space.

14. The electrical connector of claim 6, wherein the contact receiving body includes an insertion end; and a second locking mechanism positioned proximate to the insertion end.

15. The electrical connector of claim 14, wherein the second locking mechanism engages the first locking mechanism when the contact receiving body is positioned in the body receiving space.

16. The electrical connector of claim 15, wherein the first locking mechanism has an angled surface and a retention surface facing the insertion direction.

17. The electrical connector of claim 16, wherein the second locking mechanism has a cantilevered latching arm having a free end and an opposite fixed end connected to the contact receiving body.

18. The electrical connector of claim 17, wherein the latching arm extends from the fixed end to the free end in the insertion direction.

19. The electrical connector of claim 18, wherein the latching arm has a catch projection positioned on the free end that engages with the retention surface when the contact receiving body is positioned in the body receiving space.

* * * * *